US010658770B1

(12) United States Patent
Wu

(10) Patent No.: US 10,658,770 B1
(45) Date of Patent: May 19, 2020

(54) PRESS AND SPRING-BACK TYPE TERMINAL BLOCK

(71) Applicants: DINKLE ENTERPRISE CO., LTD., New Taipei (TW); DINKLE ELECTRIC MACHINERY (CHINA) CO., LTD., Kunshan, Jiangsu (CN)

(72) Inventor: Shang-Tsai Wu, New Taipei (TW)

(73) Assignees: DINKLE ENTERPRISE CO., LTD., New Taipei (TW); DINKLE ELECTRIC MACHINERY (CHINA) CO., LTD., Kunshan, Jiangsu (CN)

( * ) Notice: Subject to any disclaimer, the term of this patent is extended or adjusted under 35 U.S.C. 154(b) by 0 days.

(21) Appl. No.: 16/540,023

(22) Filed: Aug. 13, 2019

(51) Int. Cl.
*H01R 9/24* (2006.01)
*H01R 4/48* (2006.01)

(52) U.S. Cl.
CPC ..... *H01R 9/2416* (2013.01); *H01R 4/4836* (2013.01)

(58) Field of Classification Search
CPC ..... H01R 9/2416; H01R 4/4836; H01R 4/24
See application file for complete search history.

(56) References Cited

U.S. PATENT DOCUMENTS

| | | | | |
|---|---|---|---|---|
| 6,682,364 | B2 * | 1/2004 | Cisey | H01R 9/2666 439/441 |
| 10,014,594 | B1 * | 7/2018 | Wu | H01R 4/4827 |
| 2004/0102078 | A1 * | 5/2004 | Miyoshi | H01R 4/4836 439/387 |
| 2016/0248174 | A1 * | 8/2016 | Ludewig | H01R 9/223 |

* cited by examiner

*Primary Examiner* — Abdullah A Riyami
*Assistant Examiner* — Nader J Alhawamdeh
(74) *Attorney, Agent, or Firm* — Chun-Ming Shih; HDLS IPR Services

(57) ABSTRACT

A press and spring-back terminal block, includes a housing (1), a conductive terminal (2), a retainer assembly (3) and a rocker (4). The conductive terminal (2) is arranged inside the housing (1). The retainer assembly (3) includes a control member (30) and an elastic sheet (31) actuated by the control member (30). The elastic sheet (31) includes a stopping edge (310) and a retaining end (311) extended from the stopping edge (310) and toward the conductive terminal (2). When the control member (30) is actuated, it is abutted by the stopping edge (310) to allow the retaining end (311) to swing toward one side away from the conductive terminal (2). The rocker (4) is arranged inside the housing (1) and includes a first end portion (41) opposite from the lead wire insertion hole (11) and a second end portion driven to move relative to the control member (30).

10 Claims, 8 Drawing Sheets

PRESS AND SPRING-BACK TYPE TERMINAL BLOCK

BACKGROUND OF THE INVENTION

Field of the Invention

The technical field relates to an electrical connector, in particular, to a press and spring-back type terminal block.

Description of Related Art

A terminal block is an electronic component widely used in various machines or tools with the needs for electrical connection, and it can be used for the connection with, such as, cables, control lines or data transmission wires.

For the lead wire insertion operation performed on an existing terminal block, it typically requires the use of the tool of, such as, a flathead screwdriver, to exert pressure on the so-called retainer of the handle in order to retract the spring sheet inside the terminal block, such that after the lead wire is inserted and positioned inside, the retainer is then released to allow the spring sheet to clamp the lead wire and to achieve electrical connection. During the aforementioned operation, it is necessary for the user to use one hand to hold a tool to continue to exert pressure on the retainer in order to allow the other hand to insert the lead wire therein. Consequently, such design of conventional terminal block is inconvenient.

In view of above, the inventor seeks to overcome the aforementioned drawbacks associated with the currently existing technology after years of research and development along with the utilization of academic theories, which is also the objective of the development of the present invention.

SUMMARY OF THE INVENTION

The primary objective of the present invention is to provide a press and spring-back terminal block in order to facilitate the lead wire insertion operation.

To achieve the aforementioned objective, the present invention provides a press and spring-back terminal block, used for a lead wire to insert therein in order to achieve electrical connection, comprising: a housing, a conductive terminal, a retainer assembly and a rocker. The housing includes an actuation space therein and a lead wire insertion hole provided for the lead wire to be inserted into the actuation space. The conductive terminal is arranged inside the actuation space and located at one side extended from the lead wire insertion hole. The retainer assembly is arranged inside the actuation space and comprises a control member and an elastic sheet actuated by the control member, and the elastic sheet includes a stopping edge, and a retaining end extended from the stopping edge and toward the conductive terminal, such that when the control member is actuated, it is abutted against the stopping edge in order to swing the retaining end toward one side away from the conductive terminal. The rocker is arranged inside the actuation space and includes a first end portion opposite from the lead wire insertion hole, and a second end portion driven to move relative to the control member, thereby forming the rocker.

DETAILED DESCRIPTION OF THE INVENTION

The following provides a detailed technical content of the present invention along with the accompanied drawings. However, the accompanied drawings are provided for reference and illustrative purpose only such that they shall not be used to limit the scope of the present invention.

Figure 1:
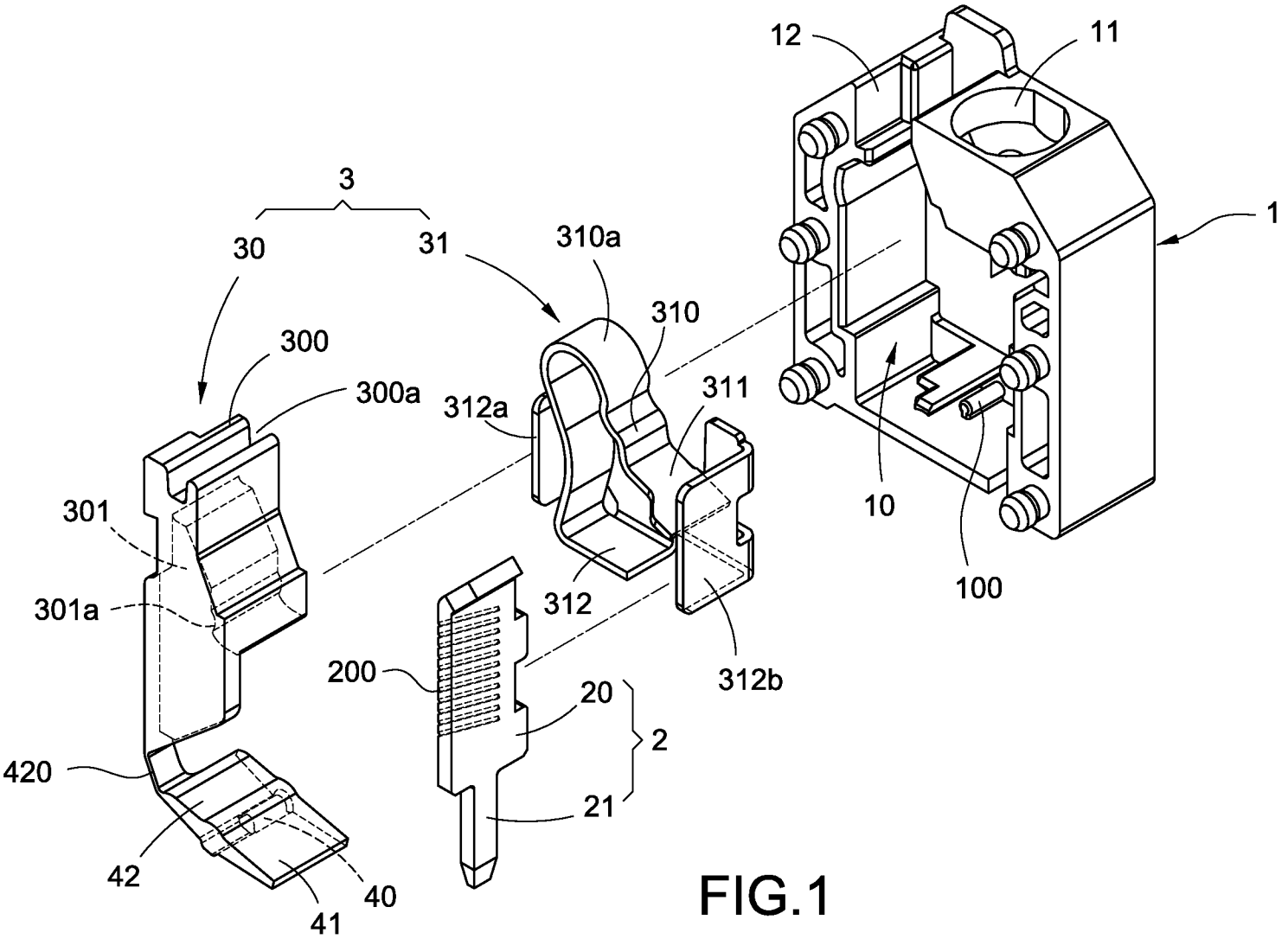
FIG. 1 is a perspective exploded view of a first exemplary embodiment of the present invention.
Figure 2:
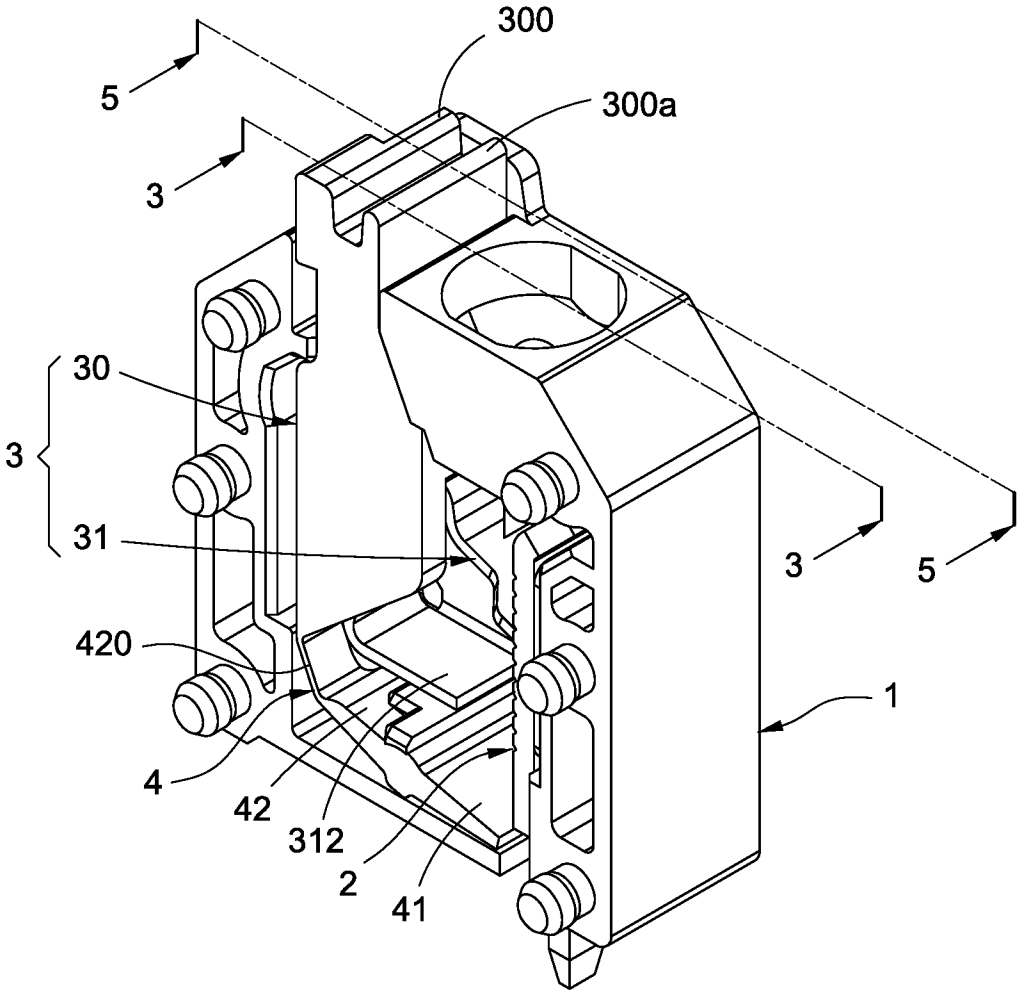
FIG. 2 is a perspective assembly view of a first exemplary embodiment of the present invention.

Please refer to FIG. 1 and FIG. 2, showing a perspective exploded view and a perspective assembly view according to a first exemplary embodiment of the present invention. The present invention provides a press and spring-back terminal block, capable of facilitating a lead wire 5 to be inserted therein in order to achieve electrical connection between the terminal block and the lead wire. The terminal block comprises a housing 1, a conductive terminal 2, a retainer assembly 3 and a rocker 4; wherein:

The housing 1 can be made of an insulation material, and can be additionally arranged according to the number of lead wires 5 required to be inserted. In an exemplary embodiment of the present invention, each housing 1 is provided for a lead wire 5 to be inserted and connected thereto, and each housing 1 includes an actuation space 10 and a lead wire insertion hole 11 for each lead wire 5 to be inserted into the actuation space 10. The actuation space 10 has an opening shape and is formed at one side of the housing 1 in order to allow the aforementioned structural members to be placed inside the actuation space 10 from one side of the housing 1.

The conductive terminal 2 is arranged inside the aforementioned actuation space 10 and is located at one side of the housing 1 with the lead wire insertion hole 11 extended therefrom, in order to allow the lead wire 5 to be electrically connected to the conductive terminal 2 after being inserted into the lead wire insertion hole 11. The conductive terminal 2 includes a conductive connection portion 20 having a large area, and a connecting leg 21 extended from the conductive connection portion 20. In addition, the conductive connection portion 20 is formed of an engagement pattern 200 thereon in order to increase the friction during the contact with the lead wire 5.

The retainer assembly 3 is also arranged inside the actuation space 10 and comprises a control member 30 and an elastic sheet 31 actuated by the control member 30. Please refer to FIG. 3 and FIG. 4. In an exemplary embodiment of the present invention, the control member 30 is arranged at another side of the actuation space 10 opposite from the conductive terminal 2, and an opening hole 12 is formed on top of the housing 1. The control member 30 includes a press portion 300 protruded therefrom and arranged opposite from the opening hole 12. The press portion 300 includes a slot **300*a* formed thereon to allow a tool, such as a flathead screwdriver, to exert force thereon in order to fasten the press portion 300 into the opening hole 12, thereby allowing the control member 30 to actuate the elastic sheet 31 inside the actuation space 10. In addition, the control member 30 includes a receiving area 301 formed to recess inward thereon and provided to allow the elastic sheet 31** to be stacked thereon.

According to the above, the elastic sheet 31 includes a stopping edge 310, a retaining end 311 extended from the stopping edge 310, and a base portion 312 provided to allow the elastic sheet 31 to be stably arranged inside the actuation space 10. In an exemplary embodiment of the present invention, the base portion 312 is bent to extend with a first side wall 312 and a second side wall 312*b*. The first side wall 312*a* abuts against one side of the actuation space 10, and the second side wall 312*b* abuts against another side of the actuation space 10 in order to allow the elastic sheet 31 to be supported inside the actuation space 10. In addition, the base portion 312 is further bent to extend with an elastic section 310*a* to connect to the stopping edge 310, and allowing the retaining end 311 extended from the stopping edge 310 to face toward the second side wall 312*b*. Furthermore, as the elastic sheet 31 is arranged inside the actuation space 10, the retaining end 311 faces toward the aforementioned conductive terminal 2 (as shown in FIG. 3).

The rocker 4 is also arranged inside the actuation space 10 of the aforementioned housing 1. The rocker includes a hinge portion 40, a first end portion 41 located at one side of the hinge portion 40 and a second end portion 42 located at another side of the hinge portion 40. In addition, the actuation space 10 of the housing 1 includes a pivotal axle 100 provided to allow the hinge portion 40 of the rocker 4 to be pivotally attached onto the pivotal axle 100, such that the first end portion 41 is arranged opposite from the lead wire insertion hole 11, the second end portion 42 is arranged opposite from the control member 30, and the second end portion 42 is adjacent to the control member 30 or is actuated by the control member 30 through the structural connection. In a first exemplary embodiment of the present invention, the rocker 4 can be made of a plastic material, and can be integrally formed with the control member 30 via a connecting portion 420, such that when the control member 30 is moving upward or downward, it is able to drive the first and second end portions 41, 42 of the rocker 4 to perform rocker swing movement.

In view of the above, through the aforementioned structure and assembly, a press and spring-back terminal block of the present invention is achieved.

Figure 3:
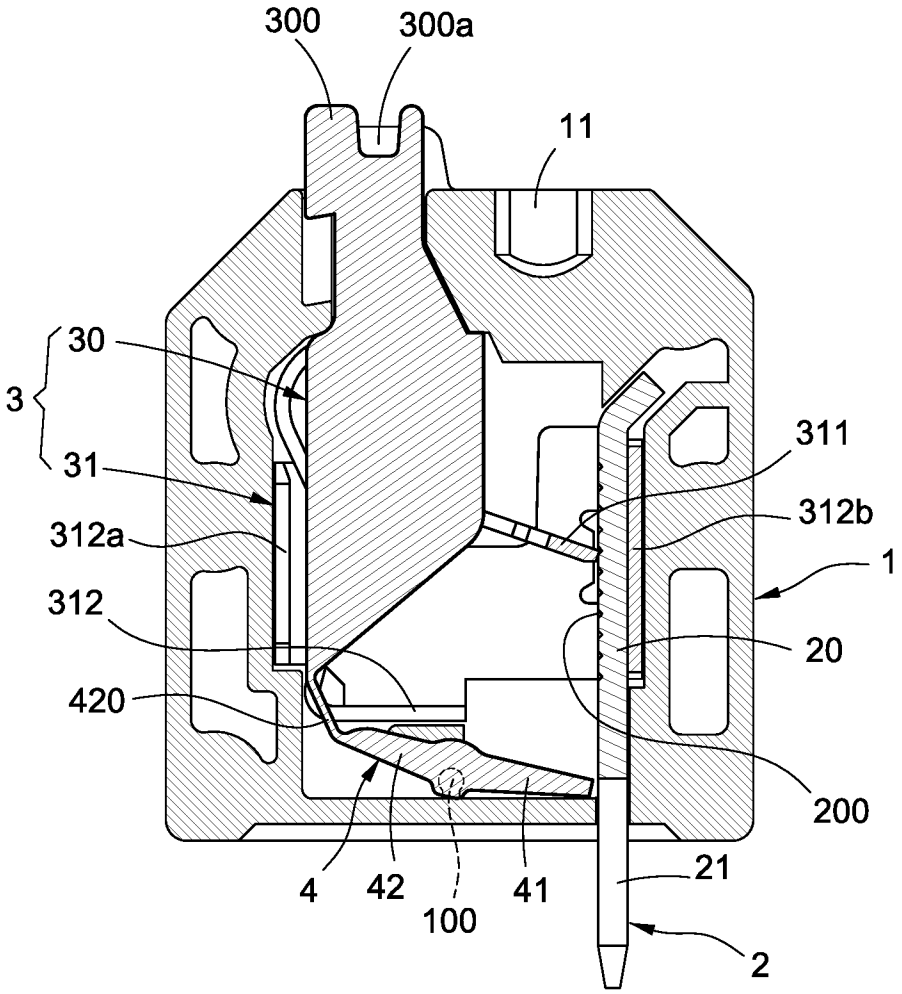
FIG. 3 is a cross sectional view taken along line 3-3 shown in FIG. 2.
Figure 4:
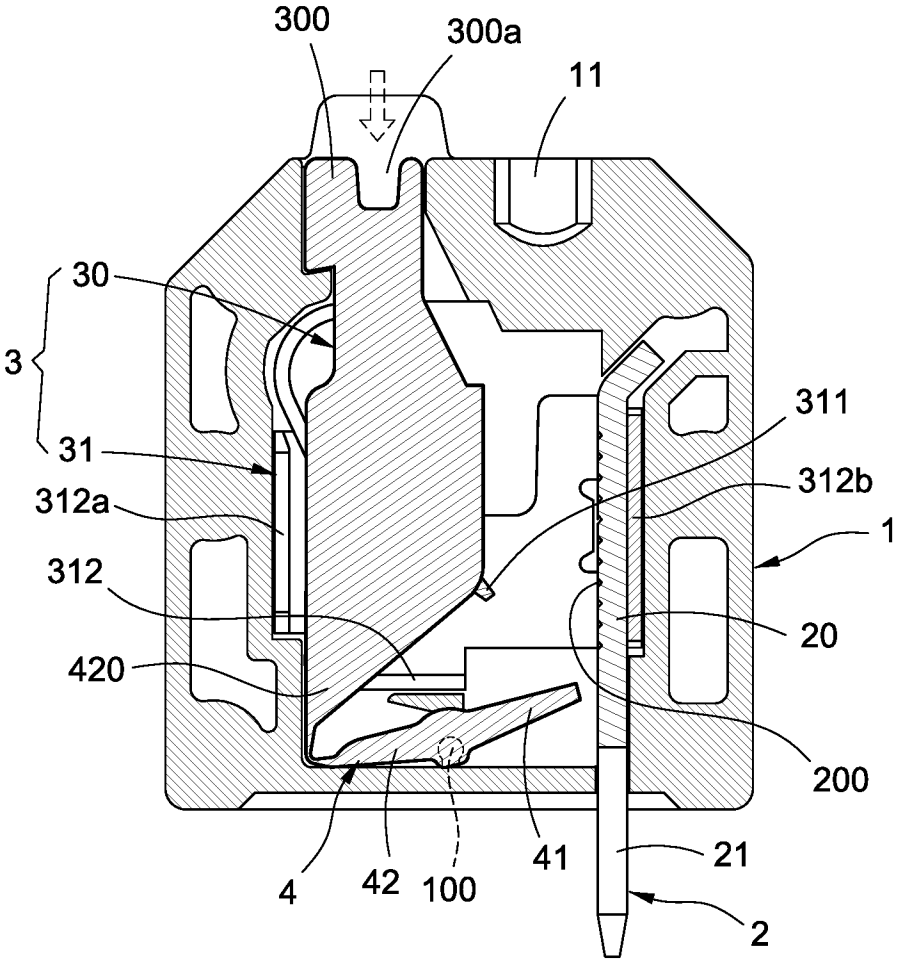
FIG. 4 is an actuation schematic view of FIG. 3.
Figure 5:
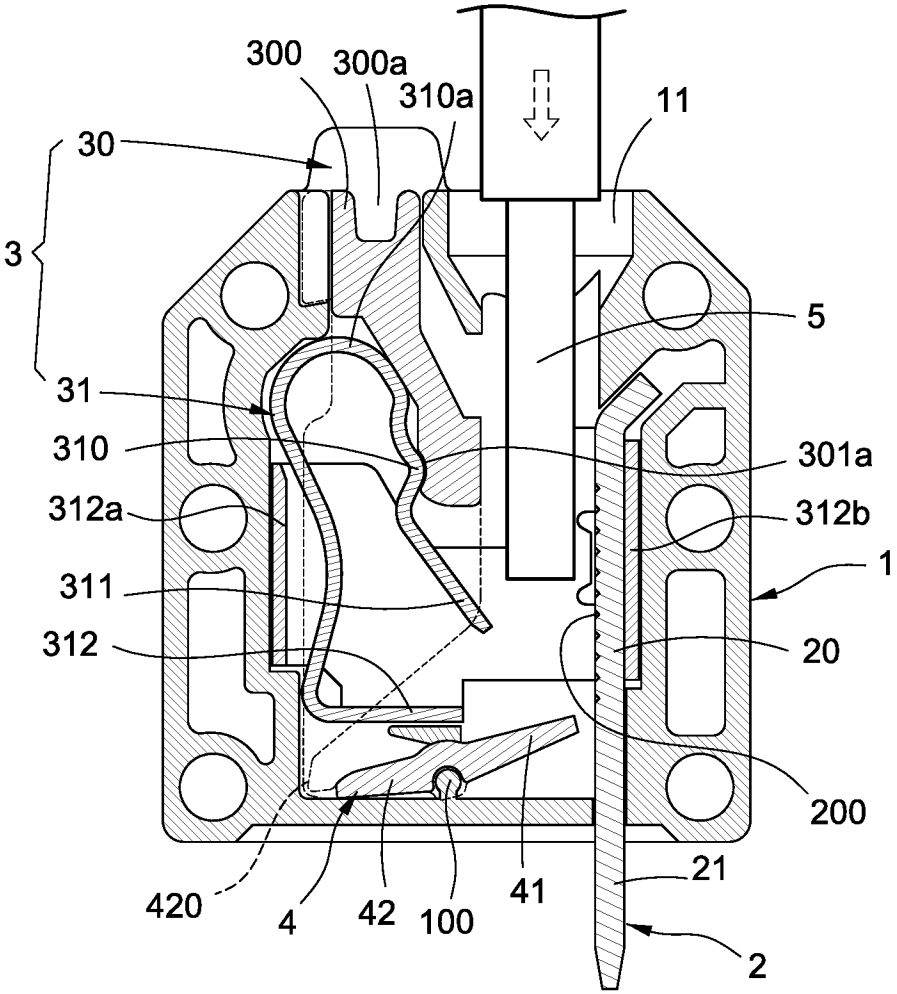
FIG. 5 is a cross sectional view taken along line 5-5 shown in FIG. 2.

Accordingly, as shown in FIG. 3 and FIG. 4, when the lead wire 5 is inserted, user's hand or tool can press the press portion 300 into the housing 1 in order to allow the control member 30 to move downward inside the actuation space 10 and to drive the elastic sheet 31. At this time, the second end portion 42 of the rocker 4 is driven by the downward swing of the control member 30 to cause the first end portion 41 to move upward. Next, as shown in FIG. 5, after the control member 30 is pressed downward, it allows the control member 30 to actuate the elastic sheet 31, i.e. to push the stopping edge 310 of the elastic sheet 30, thereby causing the retaining end 311 to swing toward one side away from the conductive terminal 2. At the same time, the stopping edge 310 also abuts against the control member 30 in order to prevent the control member 30 to move upward. In an exemplary embodiment of the present invention, a locking edge 301*a* configured to abut against the stopping edge 310 is formed on an inner wall of the receiving area 301 of the control member 30. Nevertheless, in other exemplary embodiments, as long as a sufficient resistance is established to prevent the control member 30 from moving upward when the stopping edge 310 abuts against the control member 30, such configuration is adequate. For example, an increase of the friction of the contact between the stopping edge 310 and the control member 30 can be an adequate configuration to achieve such effect.

Figure 6:
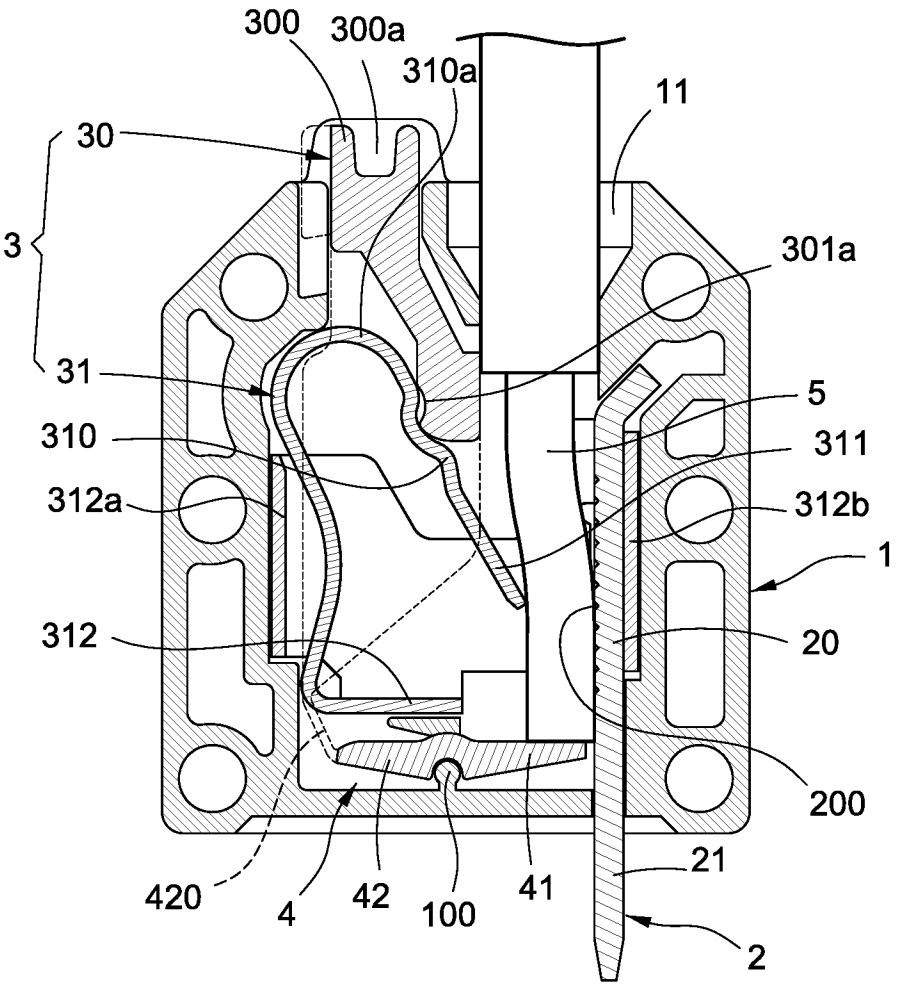
FIG. 6 is an actuation schematic view of FIG. 5.

Furthermore, please refer to FIG. 5, after the retaining end 311 of the aforementioned elastic sheet 31 swings toward one end away from the conductive terminal 2, it is able to allow the lead wire 5 to be inserted from the lead wire insertion hole 11, and to push the lead wire 5 to the first end portion 41 of the rocker 4, as shown in FIG. 6. At this time, the first end portion 41 of the rocker 4 swings downward due to the push of the lead wire 5, and the second end portion 42 is lifted upward. In addition, since the connecting portion 420 drives the control member 30 to move upward, the lead wire 5 can be pressed onto the conductive terminal 2 when the retaining end 311 swings toward the conductive terminal 2, thereby achieving the effect and purpose of electrical connection.

Figure 7:
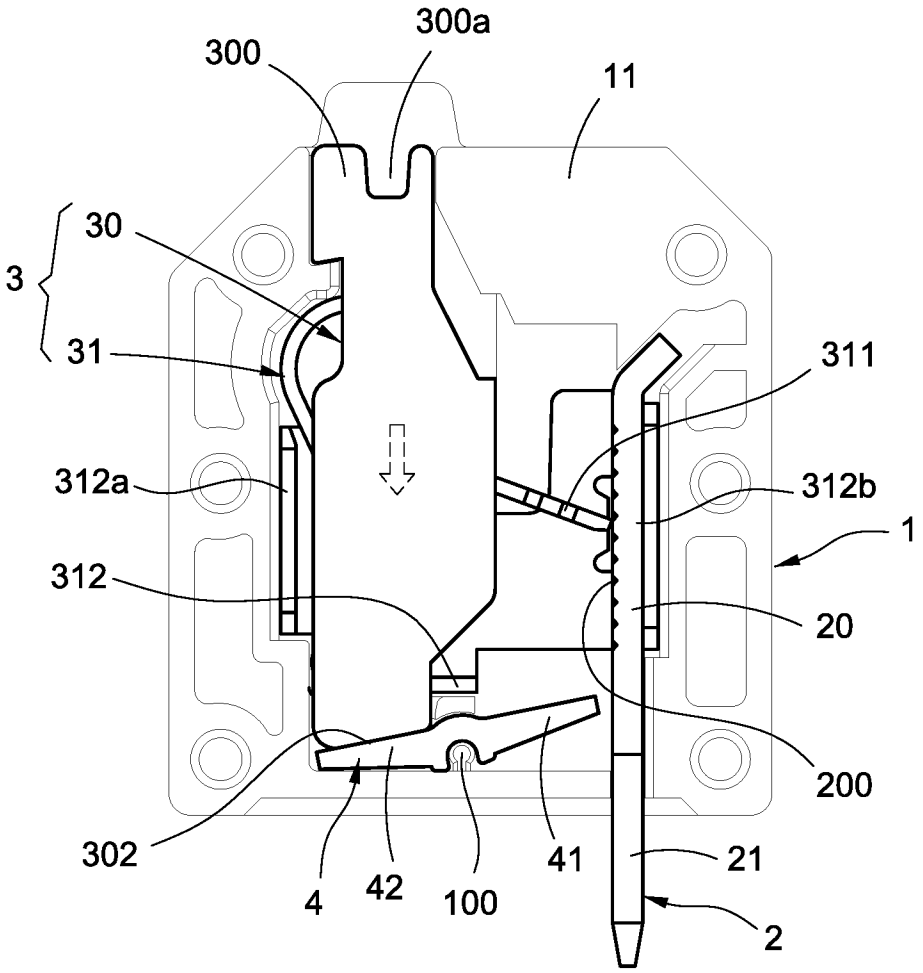
FIG. 7 is a cross sectional view according to a second exemplary embodiment of the present invention.
Figure 8:
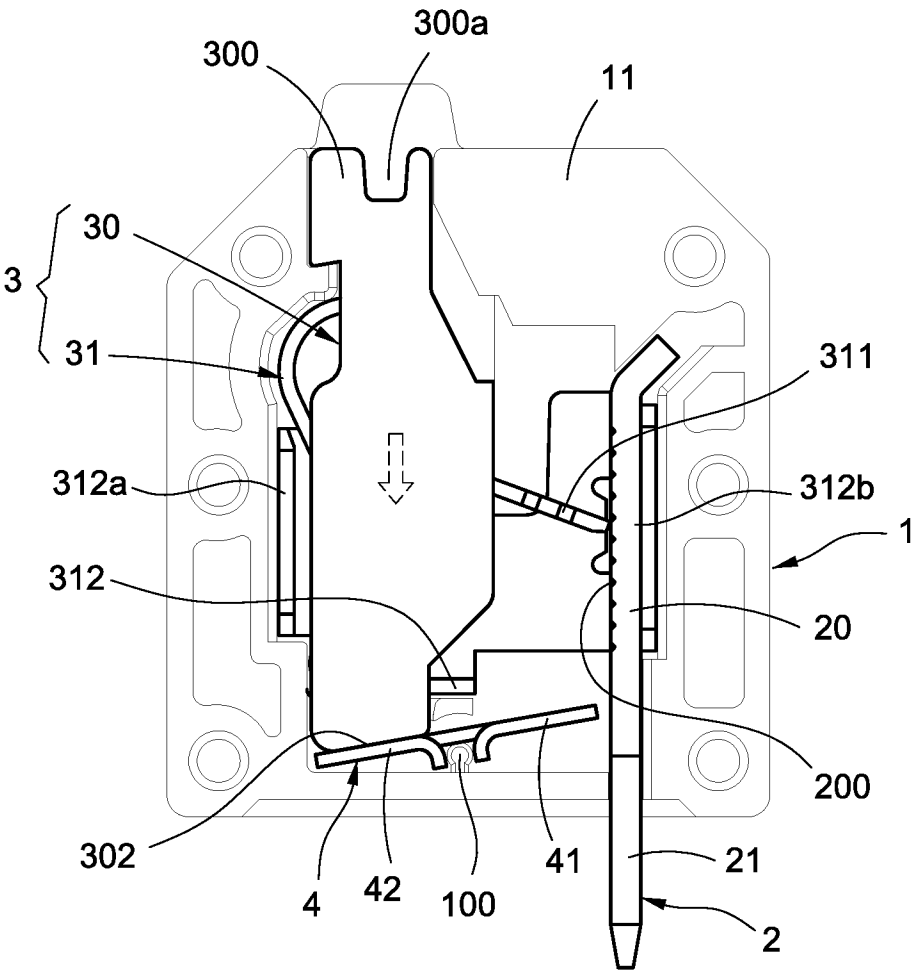
FIG. 8 is a cross sectional view according to a third exemplary embodiment of the present invention.

Moreover, as shown in FIG. 7, in another exemplary embodiment of the present invention, the rocker 4 can be made of a metal material, and an area underneath the controller 30 includes a driving surface 302 opposite from the second end portion 42 in order to push the rocker 4 for actuation, or to be actuated due to the push of the second end portion 42 of the rocker 4. As shown in FIG. 8, the rocker 4 made of a metal material can also be configured to have other forms. For example, it can be made via the stamping process of a metal sheet.

In view of the above, the present invention is able to achieve the objectives of the present invention and to overcome the drawbacks of known arts. The present invention is novel and of inventive step, which satisfies the patentability requirements.

The above describes the preferable and feasible exemplary embodiments of the present invention for illustrative purposes only, which shall not be treated as limitations of the scope of the present invention. Any equivalent changes and modifications made in accordance with the scope of the claims of the present invention shall be considered to be within the scope of the claim of the present invention.

What is claimed is:

1. A press and spring-back terminal block, used for a lead wire (5) to insert therein in order to achieve electrical connection, comprising:

a housing (1) having an actuation space (10) therein and a lead wire insertion hole (11) provided for the lead wire (5) to be inserted into the actuation space (10);

a conductive terminal (2) arranged inside the actuation space (10) and located at one side with the lead wire insertion hole (11) extended therefrom;

a retainer assembly (3) arranged inside the actuation space (10) and comprising a control member (30) and an elastic sheet (31) actuated by the control member (30), and the elastic sheet (31) having a stopping edge (310), and a retaining end (311) extended from the stopping edge (310) and toward the conductive terminal (2), such that when the control member (30) is actuated, it is abutted against the stopping edge (310) in order to swing the retaining end (311) toward one side away from the conductive terminal (2); and a rocker (4) arranged inside the actuation space (10) and having a first end portion (41) opposite from the lead wire insertion hole (11), and a second end portion (42) driven to move relative to the control member (30), thereby forming the rocker (4).

2. The press and spring-back terminal block according to claim 1, wherein the housing (1) includes an opening hole (12) formed opposite from the control member (30), and the controller member (30) includes a press portion (300) protruded therefrom and arranged opposite from the opening hole (12).

3. The press and spring-back terminal block according to claim 1, wherein the conductive terminal (2) includes an engagement pattern (200) formed thereon.

4. The press and spring-back terminal block according to claim 1, wherein the control member (30) includes a receiving area (301) formed to recess inward thereon and provided to allow the elastic sheet (31) to be stacked thereon.

5. The press and spring-back terminal block according to claim 4, wherein an inner wall of the receiving area (301) includes a locking edge (301*a*) formed thereon and provided to abut against the stopping edge (310).

6. The press and spring-back terminal block according to claim 1, wherein the elastic sheet (31) further includes a base portion (312), and the base portion (312) is bent to extend with an elastic section (310*a*) for connecting to the stopping edge (310).

7. The press and spring-back terminal block according to claim 6, wherein the base portion (312) is bent to extend with a first side wall (312*a*) and a second side wall (312*b*); the first side wall (312*a*) abuts against one side of the actuation space (10), and the second side wall (312*b*) abuts against another side of the actuation space (10).

8. The press and spring-back terminal block according to claim 1, wherein the rocker (4) is made of a plastic material, and is integrally formed with the control member (30) via a connecting portion (420).

9. The press and spring-back terminal block according to claim 1, wherein the rocker (4) is made of a metal material, and an area underneath the controller (30) includes a driving surface (302) being opposite from the second end portion (42).

10. The press and spring-back terminal block according to claim 1, wherein the rocker (4) further includes a hinge portion (40) arranged between the first and second end portions (41, 42), and the actuation space (10) includes a pivotal axle (100); the hinge portion (40) is pivotally attached onto the pivotal axle (100).

* * * * *